US009095184B2

(12) United States Patent
Tseng

(10) Patent No.: US 9,095,184 B2
(45) Date of Patent: Aug. 4, 2015

(54) STEP-COUNTING SHOE

(71) Applicant: Shen-Ko Tseng, Taipei (TW)

(72) Inventor: Shen-Ko Tseng, Taipei (TW)

( * ) Notice: Subject to any disclaimer, the term of this patent is extended or adjusted under 35 U.S.C. 154(b) by 334 days.

(21) Appl. No.: 13/848,062

(22) Filed: Mar. 21, 2013

(65) Prior Publication Data

US 2013/0247424 A1 Sep. 26, 2013

(51) Int. Cl.
*H01L 41/08* (2006.01)
*H01L 41/113* (2006.01)
*A43B 3/00* (2006.01)

(52) U.S. Cl.
CPC ..... *A43B 3/0005* (2013.01); *A43B 3/001* (2013.01); *A43B 3/0015* (2013.01)

(58) Field of Classification Search
CPC ... H01L 41/044; H01L 41/107; H01L 41/042; H01L 41/1132; H01L 41/1136; H05B 41/2822; B06B 2201/55; H02M 77/48; G01L 1/16; G01L 23/10; G01L 9/008; G01L 9/0022; H02N 2/181; H02N 2/18; H02N 2/183; H02N 2/186; F23Q 3/002
USPC ..... 310/318, 319, 338, 339
See application file for complete search history.

(56) References Cited

U.S. PATENT DOCUMENTS

2009/0267783 A1* 10/2009 Vock et al. ..... 340/669
2011/0037349 A1* 2/2011 Sham et al. ..... 310/339
2011/0131838 A1* 6/2011 Pas et al. ..... 36/140

* cited by examiner

*Primary Examiner* — Thomas Dougherty

(57) ABSTRACT

A step-counting shoe comprises a power generation device, a pedometer device, and a display device. When the step-counting shoe is applied with a force, the power generation device produces electrical energy by electromagnetic induction or piezoelectric effect without external power supply, so as to generate power for the pedometer device and the display device automatically during the user walking. Additionally, the present invention provides a variety of types of power generation devices, so a suitable power generation device can be adopted depending on the power demand, thickness of step-counting shoe, and/or costs.

17 Claims, 10 Drawing Sheets

STEP-COUNTING SHOE

BACKGROUND OF THE INVENTION

1. Field of the Invention

The present invention relates to a step-counting shoe, and more particularly to a step-counting shoe utilizing electromagnetic induction or piezoelectricity unit to produce electrical energy for recording the number of steps taken in walking.

2. Description of the Prior Art

In order to raise public environmental awareness, more and more green products are developed and manufactured. Wherein, there are some products utilizing simple mechanism to produce electrical energy, for example, a hand-pressing flashlight and a power-generation bicycle.

Nowadays, in order to maintain health and fitness, pedometer devices are used for motivating people to walk more. In addition, the conventional pedometer device should be worn on user's body to count steps and measure distance and calories consumed in walking, leading to inconvenience of use. Therefore, integrating pedometer device with shoes is one of the solutions to improve the problem mentioned above.

In general, the accompanied step-counting devices should be completely portable and very light weight, causing the batteries thereof to be as thin as possible. However, the thin batteries contain mercury (Hg), a toxic heavy metal that can result in environmental contamination. Moreover, if the accompanied step-counting devices are without waterproof, the batteries thereof would be easy to leak current, be affected with damp or damage. For a step-counting shoe, the battery thereof is configured within the shoe body, leading to the difficulty to replace the battery in the step-counting shoe.

Accordingly, how to develop a step-counting shoe which can produce electrical energy by simple mechanism without replacing the battery is the primary topic in this field.

SUMMARY OF THE INVENTION

Therefore, in order to improve the problem described previously, a scope of the present invention is to provide a step-counting shoe which can convert the kinetic energy of walking into electrical energy. Furthermore, this step-counting shoe not only solves the problem of battery but also supplies electrical energy for pedometer device and display device thereof.

According to an embodiment, the step-counting shoe applied with a force to generate an electrical energy comprises a shoe body, a power generation device, a pedometer device, and a display device. Wherein, the shoe body has a bottom and an outer surface; the power generation device is coupled with the pedometer device and the display device, and used for providing electrical energy to these two devices; and meanwhile, the pedometer device is utilized for recording a number of steps; the display device has an at least one LED unit, and utilized for showing the number of steps.

In actual application, the power generation device is configured to the bottom of shoe body, and used for bearing a force to produce electrical energy. To be noticed, the power generation device of the present invention has a variety of types, the detailed descriptions are as follows.

In an embodiment, the power generation device of the present invention comprises a first housing, a second housing, a magnetic component, an induction coil, and a first piezoelectricity module. The first housing has an at least one first halving joint. The second housing has an at least one second halving joint, wherein the second halving joint is removably assembled to the first halving joint for forming a space between the first housing and the second housing. The magnetic component is mounted on the first housing and inside the space. The induction coil is mounted on the second housing and inside the space and configured around the periphery of the magnetic component. The first piezoelectricity module is configured between the magnetic component and the second housing. Wherein, when the power generation device is applied with a force, relative motion is produced between the first housing and the second housing for causing the induction coil to generate a magnetic flux to produce an induced current, and meanwhile, the first piezoelectricity module absorbs the pressure between the magnetic component and the second housing to produce a first electric charge.

In one of the embodiment, the first piezoelectricity module mentioned above comprises including, but not limited to, an elastomer and a piezoelectricity component. The elastomer has a first elasticity coefficient, and the piezoelectricity component is configured in the elastomer for producing the first electric charge. The piezoelectricity component comprises a plurality of piezoelectricity units, and each piezoelectricity unit has a second elasticity coefficient and comprises a piezoelectric material and a metal sheet, wherein the second elasticity coefficient is larger than the first elasticity coefficient. Moreover, the power generation device can optionally comprise a first flexible component configured between the first housing and the second housing, when the power generation device is applied with a force, relative motion is produced between the first housing and the second housing, and the first flexible component provides a resilience to the first housing or the second housing.

In actual application, the power generation device of the present invention can optionally comprise a control device and an electricity storing device. The control device is coupled with the pedometer device and the display device, utilized for controlling the display device to show the number of steps. The electricity storing device is coupled with the induction coil and the first piezoelectricity module, utilized for storing the induced current and the first electric charge to supply power to the pedometer device or the display device.

When the power generation device comprises the electricity storing device mentioned above, it can further comprise a second display device coupled with the electricity storing device. The second display device has an at least one LED unit, and utilized for showing the dump energy of the electricity storing device. To be noticed, the display device uses different colors to show the dump energy of the electricity storing device, but is not limited to this manner. That is to say, the display device can show the dump energy by other manners, such as the amount of luminous spots or the flicker frequency of light.

Additionally, the step-counting shoe further provides charging function. To be more precise, the present invention can comprise a rectifying device coupled or integrated with the power generation device for receiving the induced current, the first electric charge or other alternating currents (AC) to convert and generate a direct current (DC), so the interface device coupled with the rectifying device can supply the direct current to an external electronic apparatus.

In another embodiment, the power generation device of the present invention comprises a first housing, a second housing, a magnetic component, an induction coil, a third housing, and a second piezoelectricity module. The first housing has an at least one first halving joint. The second housing has an at least one second halving joint, wherein the second halving joint is removably assembled to the first halving joint for forming a space between the first housing and the second housing. The magnetic component is mounted on the first housing and inside the space. The induction coil is mounted on the second housing and inside the space and configured around the periphery of the magnetic component. The third housing has a third halving joint, and the third halving joint is utilized for holding the first halving joint. The second piezoelectricity module is configured between the second housing and the third housing. Wherein, when the power generation device is applied with a force, relative motion is produced between the first housing and the second housing for causing the induction coil to generate a magnetic flux to produce an induced current, and meanwhile, the second piezoelectricity module absorbs the pressure between the second housing and the third housing to produce a second electric charge.

In one of the embodiment, the second piezoelectricity module mentioned above comprises including, but not limited to, an elastomer and a piezoelectricity component. The elastomer has a first elasticity coefficient, and the piezoelectricity component is configured in the elastomer for producing the second electric charge. The piezoelectricity component comprises a plurality of piezoelectricity units, and each piezoelectricity unit has a second elasticity coefficient and comprises a piezoelectric material and a metal sheet, wherein the second elasticity coefficient is larger than the first elasticity coefficient. Moreover, the power generation device can optionally comprise a first flexible component configured between the first housing and the second housing, when the power generation device is applied with a force, relative motion is produced between the first housing and the second housing, and the first flexible component provides a resilience to the first housing or the second housing. In actual application, the power generation device can further comprise a second flexible component configured between the second housing and the third housing, when the power generation device is applied with a force, relative motion is produced between the second housing and the third housing, and the second flexible component provides a resilience to the second housing or the third housing.

In actual application, the power generation device of the present invention can optionally comprise control device, electricity storing device, second display device, rectifying device, and interface device. Wherein the control device, second display device, and interface device are in essence the same with the first embodiment mentioned previously, thus these components need not be elaborate any further. To be noticed, the difference between the two embodiments is that, in this embodiment, the rectifying device is coupled with the power generation device for receiving the induced current and the second electric charge to generate a direct current; and the electricity storing device is coupled with the induction coil and the second piezoelectricity module, utilized for storing the induced current and the second electric charge to supply power to the rectifying device and the pedometer device.

In another embodiment, the power generation device of the present invention comprises a first housing, a second housing, a magnetic component, and an induction coil. The first housing has an at least one first halving joint. The second housing has an at least one second halving joint, wherein the second halving joint is removably assembled to the first halving joint for forming a space between the first housing and the second housing. The magnetic component is mounted on the first housing and inside the space. The induction coil is mounted on the second housing and inside the space and configured around the periphery of the magnetic component. Wherein, when the power generation device is applied with a force, relative motion is produced between the first housing and the second housing for causing the induction coil to generate a magnetic flux to produce an induced current.

Furthermore, in one of the embodiment, the power generation device of the present invention comprises an elastomer and a piezoelectricity component. The elastomer has a first elasticity coefficient. The piezoelectricity component is configured in the elastomer for producing a first electric charge. The piezoelectricity component comprises a plurality of piezoelectricity units, and each piezoelectricity unit has a second elasticity coefficient and comprises a piezoelectric material and a metal sheet, wherein the second elasticity coefficient is larger than the first elasticity coefficient.

To be noticed, the display device described above can further comprise a plurality of LED units optionally, wherein these LED units is arranged in two-dimensional matrix and used for showing the number of steps with a two-dimensional image. Moreover, the display device can use flicker frequency, luminous intensity, or luminous color to show the number of steps correspondingly.

According to the embodiments described above, the step-counting shoe of the present invention provides a variety of types of power generation devices, so a suitable power generation device can be adopted depending on the power demand, thickness of step-counting shoe, and/or costs. In addition, the present invention produces electrical energy by applying a force to the shoe body without external power supply or replacing the battery, so as to generate power automatically during the user walking. And additionally, the electrical energy produced thereof can be transmitted to external electrical devices. Moreover, the display device of the present invention uses different colors to show the dump energy of the electricity storing device, contributing a great convenience for users.

Many other advantages and features of the present invention will be further understood by the detailed description and the accompanying sheet of drawings.

BRIEF DESCRIPTION OF THE APPENDED DRAWINGS

To facilitate understanding, identical reference numerals have been used, where possible to designate identical elements that are common to the figures.

DETAILED DESCRIPTION OF THE INVENTION

Figure 1:
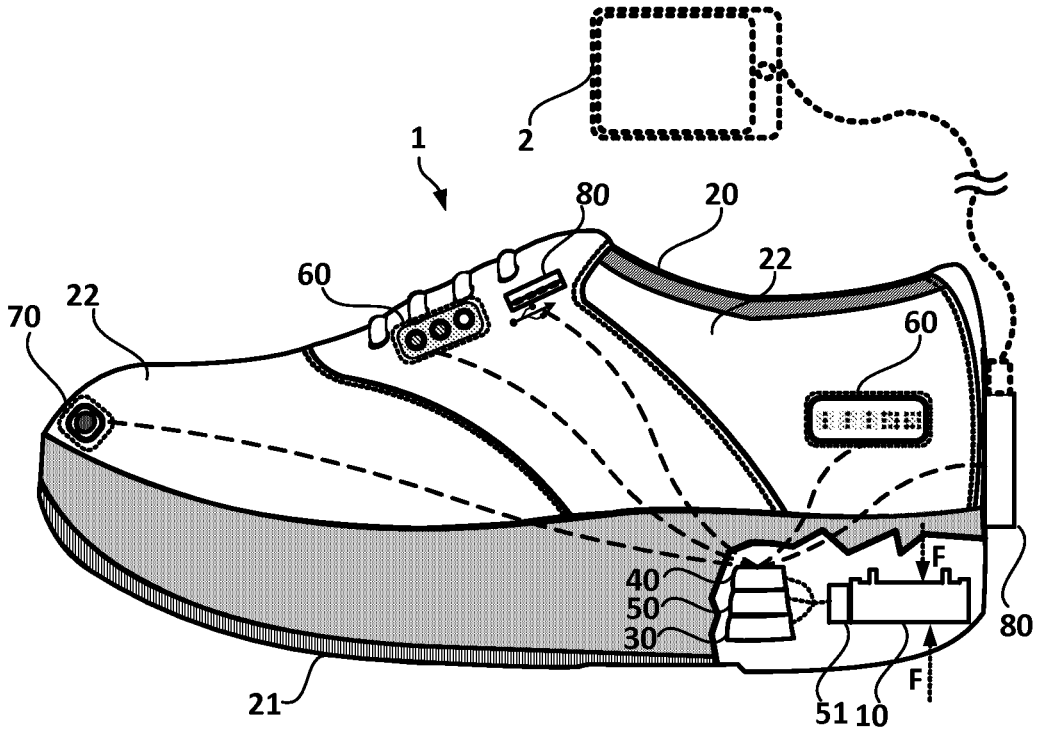
FIG. 1 is a schematic diagram illustrating a step-counting shoe according to an embodiment of the invention.

The present invention discloses a step-counting shoe which utilizes electromagnetic induction or piezoelectricity unit to produce electrical energy for recording the number of steps taken in walking. Please refer to FIG. 1. FIG. 1 is a schematic diagram illustrating a step-counting shoe according to an embodiment of the invention. As shown in FIG. 1, the step-counting shoe comprises a power generation device 10, a shoe body 20, a pedometer device 30, a control device 40, an electricity storing device 50, a rectifying device 51, an at least one display device 60, a second display device 70, and an interface device 80. Wherein, the shoe body 20, the pedometer device 30, and the display device 60 are the essential components, and the other components can be omitted if necessary.

The shoe body 20 comprises a bottom 21 and an outer surface 22. The shoe body 20 bears a force F when user is walking. The power generation device 10 is configured to the bottom 21, and used for bearing the force F to produce electrical energy. In the embodiment, the force F is weight or acting force resulting from walking. Wherein, the bottom 21 signifies the part of shoe body 20 between ground and user's foot; the power generation device 10 can be configured on the rear of bottom 21 near user's heel, the middle of bottom 21, or other effective position. In addition, the outer surface 22 mentioned above signifies the exterior of the shoe body 20 (as FIG. 1A illustrates).

The pedometer device 30 is coupled with the power generation device 10 to obtain electrical energy, and meanwhile, the pedometer device 30 can be configured in any position of the shoe body 20. Furthermore, the pedometer device 30 can be a mechanic pedometer or an electronic pedometer. In this embodiment of present invention, the pedometer device 30 is configured to the rear of bottom 21, and in order to enhance the reliability of the step-counting shoe, the pedometer device 30 further comprises an electronic accelerometer, but it is not limited to this form.

On the other hand, the present invention can comprise an at least one display device 60 optionally. The display device 60 is coupled with the power generation device 10 described above, and utilized for showing the number of steps, and meanwhile, the display device 60 has an at least one LED unit. As shown in FIG. 1, the display device 60 can be configured on any position of the outer surface 22 of the shoe body 20 discretionarily. In order to read the value easily, the display device 60 is recommended to be configured near the shoelace or the front end of the shoe body 20.

To be more precise, the at least one LED unit is a light emitting diode module (e.g., SMD), wherein each LED unit comprises at least one light emitting diode chip respectively. In an embodiment, the display device 60 is composed of a plurality of LED units, wherein these LED units is arranged in two-dimensional matrix and used for showing the number of steps with a two-dimensional image.

To take FIG. 1 as an example, each LED unit constitutes five characters, and each character is composed of a 3-by-3 matrix respectively. As shown in FIG. 1, the display device 60 shows five characters (11100), that is to say, the number of steps taken in walking is 11100. In addition, the number of steps can be expressed in decimal, centesimal, or millesimal systems. For example, the number of steps 11100 is expressed as 111 in centesimal system, so that the manufacturing cost thereof can be reduced consequently. To be noticed, the display device 60 is not limited to the description above. According to user's demands, the expression of the number of steps can be a pattern, symbol, amount of luminous spots, or the flicker frequency of light. For example, when the amount of luminous spots is one, the number of steps is larger than 1,000; when the amount of luminous spots is two, the number is larger than 5,000; when the amount of luminous spots is three, the number is larger than 10,000.

Or the display device 60 can show the number of steps with different luminous colors or luminous intensity. More specifically, the LED units of the display device 60 can comprises including, but not limited to, three light emitting diode chips whose wavelengths correspond to three primary colors respectively. With the variation of the number of steps, these three light emitting diode chips can generate different colors correspondingly. For example, when the number of steps is less than 1,000, the display device 60 emits red light; when the number of steps is between 1,000 and 10,000, the display device 60 emits yellow light; and when the number is larger than 10,000, the display device 60 emits green light. Therefore, users can know their number of steps by recognizing the luminous colors facilely.

In addition, the control device 40 can be coupled with each device in the present invention. The primary function of the control device 40 is to control the display device 60, so as to show the number of steps recorded by the pedometer device 30. In this embodiment, the control device 40 is composed of printed circuit boards (PCB) and operational circuit, and the control device 40 can obtain power source from the power generation device 10 and the electricity storing device 50. To be noticed, the control device 40 described above can be integrated into the pedometer device 30.

The electricity storing device 50 is coupled with the power generation device 10 and the pedometer device 30, utilized for storing the power generated from the power generation device 10 to supply power to the pedometer device 30. More specifically, the electricity storing device 50 can be used to not only store electrical energy but also regulate the current generated from the power generation device 10, such as induced current or electric charge. In this embodiment, the electricity storing device 50 is a rechargeable battery, but is not limited to be a capacitance, or other energy storage elements.

To be noticed, when the step-counting shoe comprises the electricity storing device 50 described above, a second display device 70 can be added on the outer surface 22 of the shoe body 20. The second display device 70 is coupled with the electricity storing device 50 and utilized for showing the dump energy of the electricity storing device 50. To be more precise, the second display device 70 evaluates the dump energy according to the output voltage or output current, and meanwhile, the second display device 70 has an at least one LED unit so as to show the dump energy with different colors. For example, when the dump energy of the electricity storing device 50 is between 61% and 100%, the second display device 70 emits green light; when the dump energy is between 21% and 60%, the second display device 70 emits blue light; and when the dump energy is lower than 20%, the second display device 70 emits red light. Moreover, the second display device 70 can show the dump energy by other manners, such as the amount of luminous spots or the flicker frequency of light.

The present invention can comprise a rectifying device 51 coupled with the power generation device 10 for receiving or regulating the current generated from the power generation device 10, such as induced current, electric charge or other alternating currents (AC), moreover, the current can be converted to a direct current (DC) at the same time. Additionally, the rectifying device 51 can also obtain electrical energy from the electricity storing device 50 described above. To be noticed, the rectifying device 51 can be integrated into the electricity storing device 50 or the power generation device 10 according to user's demands.

In this embodiment, the step-counting shoe 1 can comprise an interface device 80 coupled with the rectifying device 51 for supplying the direct current to an external electronic apparatus 2. The interface device 80 can be compatible with USB 2.0 or USB 3.0 specification depending on the needs of users. To be noticed, the interface device 80 of present invention is not limited to be coupled with the rectifying device 51, the interface device 80 can obtain electrical energy from the power generation device 10 or the electricity storing device 50 directly. In the embodiment, the interface device 80 is configured on the outer surface 22 of the shoe body 20 so as to be convenient for the connector of the external electronic apparatus 2 to plug in. Wherein, the external electronic apparatus 2 is a mobile phone, a power bank, or a rechargeable battery. However, the interface device 80 can be inbuilt into the bottom 21 of the shoe body 20 and expose a corresponding connecting plug for the connector of the external electronic apparatus 2 to plug in. Moreover, the interface device 80 described above can further comprise a cover for protecting the connecting plug when it need not be used.

In other words, the power generation device 10 of the present invention uses the force F which is applied on the shoe body 20 when user is walking to generate electrical energy, that is to say, the present invention is a green product without external power supply. To be noticed, the scope of the present invention is not limited to these embodiments. In actual application, the control device 40 and/or the electricity storing device 50 described previously can be adopted optionally depending on the demands. For example, when the step-counting shoe 1 does not comprise the electricity storing device 50, the power generation device 10 can be coupled with the pedometer device 30 and the display device 60 directly.

In addition, the step-counting shoe 1 of the present invention supplies power to external electronic apparatus 2 with the rectifying device 51 and the interface device 80; and a second display device 70 is added on the outer surface 22 of the shoe body 20 for showing the dump energy when the step-counting shoe comprises the electricity storing device 50 described above. Therefore, the second display device 70, the rectifying device 51 and the interface device 80 can be adopted optionally depending on the demands.

Furthermore, the step-counting shoe 1 of the present invention provides a variety of types of power generation devices 10, so a suitable power generation device can be adopted depending on the power demand, thickness of step-counting shoe, and/or costs. To be further understood, the detailed descriptions of power generation devices 10 are as follows.

Figure 2A:
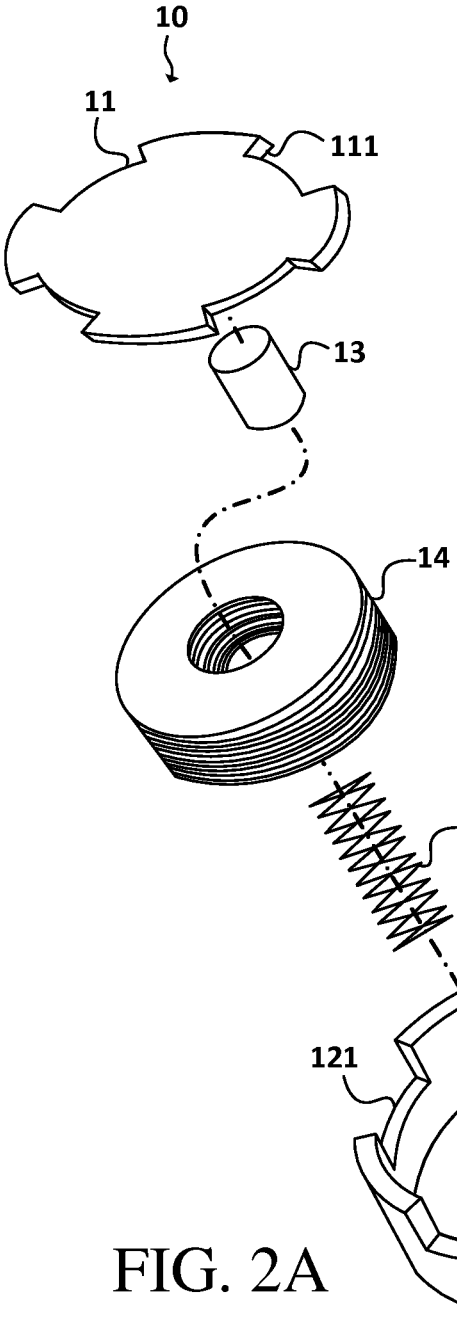
FIG. 2A is an explosion diagram illustrating a power generation device according to an embodiment of the invention.
Figure 2B:
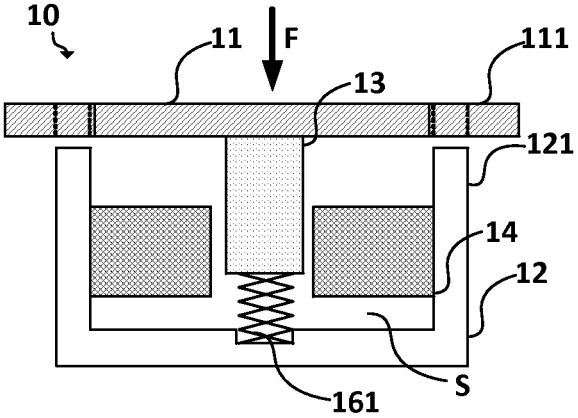
FIG. 2B is a sectional view illustrating a power generation device according to an embodiment of the invention.

Please refer to FIGS. 2A and 2B. FIG. 2A is an explosion diagram illustrating a power generation device according to an embodiment of the invention. FIG. 2B is a sectional view illustrating a power generation device according to an embodiment of the invention. In the embodiment, the power generation devices 10 comprises a first housing 11, a second housing 12, a magnetic component 13, an induction coil 14, and a first flexible component 161.

The first housing 11 has an at least one first halving joint 111. In actual application, the first halving joint 111 can be mounted on the first housing 11 or integrated with the first housing 11. In the embodiment, the first halving joint 111 is a flabellate unit, but it is not limited to this form. The second housing 12 has an at least one second halving joint 121, wherein the second halving joint 121 is removably assembled to the first halving joint 111 for forming a space S between the first housing 11 and the second housing 12.

To be more precise, in the present invention, the first housing 11 and the second housing 12 can be an upper cover and a bowling structure respectively. The first halving joint 111 and the second halving joint 121 can be slide rails, grooves, or other components for assisting relative motion between the first housing 11 and the second housing 12. Moreover, the magnetic component 13 is mounted on the first housing 11 and inside the space S, wherein the material of the magnetic component 13 can be a neodymium magnet or other magnets in the present invention.

The induction coil 14 is mounted on the second housing 12 and inside the space S and configured around the periphery of the magnetic component 13. When the first housing 11 or the second housing 12 of the power generation device 10 is applied with a force F, relative motion is produced between the first halving joint 111 and the second halving joint 121 for causing the induction coil 14 to generate a magnetic flux to produce an induced current.

In this embodiment, the induction coil 14 is coupled with the electricity storing device 50, and utilized for supplying the induced current to the electricity storing device 50. To be noticed, when the step-counting shoe 1 does not comprise the electricity storing device 50, the electricity generation components (e.g., the induction coil 14) can be coupled with the pedometer device 30 directly, so as to provide electrical energy for the pedometer device 30.

Furthermore, the power generation device 10 further comprises a first flexible component 161 which is configured between the first housing 11 and the second housing 12, when the power generation device 10 is applied with a force F, relative motion is produced between the first housing 11 and the second housing 12, and the first flexible component 161 provides a resilience to the first housing 11 or the second housing 12, so as to make the first halving joint 111 and the second halving joint 121 return to the original positions. To be more precise, when applying a force F to the power generation device 10 (as FIG. 2B illustrates), the first housing 11 and the second housing 12 may produce a relative motion and relative displacement according to the guiding direction of the first halving joint 111 and the second halving joint 121. In the embodiment, the relative motion and displacement of the first housing 11 and the second housing 12 are paralleled with the force F, but are not limited to these descriptions.

In other words, when the power generation device 10 without applied force F, the magnetic circuit formed from the magnetic component 13 and the induction coil 14 is in a non-closed status with smaller magnetic flux; when the power generation device 10 with applied force F, the magnetic circuit is in a closed status with larger magnetic flux. Therefore, the variation of magnetic flux can produce induced current. In other to provide larger variation of magnetic flux, the first flexible component 161 is embedded into a denting of the surface of second housing 12, so the magnetic component 13 can be jointed with the second housing 12 when the magnetic circuit is in a closed status.

In actual application, the first flexible component 161 can be a spring, elastic piece, or other resilient bodies. In this embodiment, when applying a force F on the power generation device 10 to pull the magnetic component 13 in or out of the induction coil 14, the magnetic component 13 can return to the original position (without applied force) by the magnetic attraction, that is to say, the first flexible component 161 can be omitted.

Figure 3A:
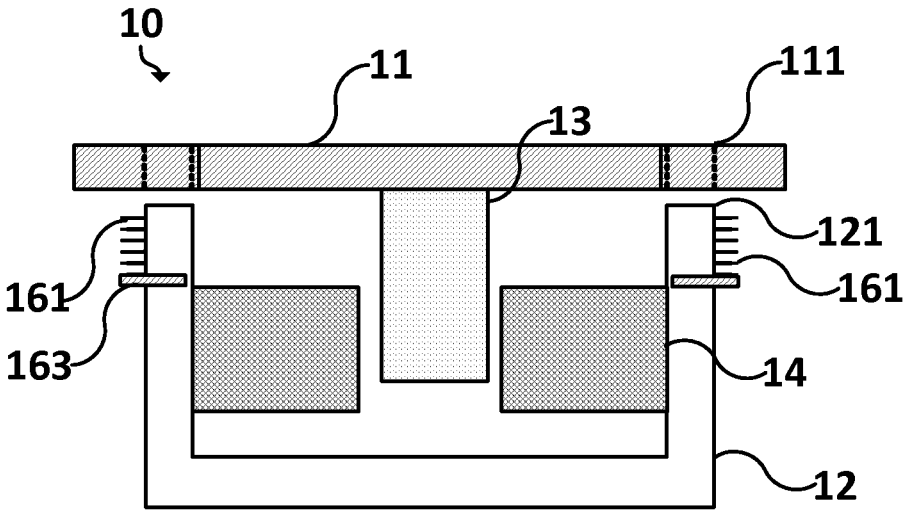
FIG. 3A is a sectional view illustrating a power generation device without applied force according to another embodiment of the invention.
Figure 3B:
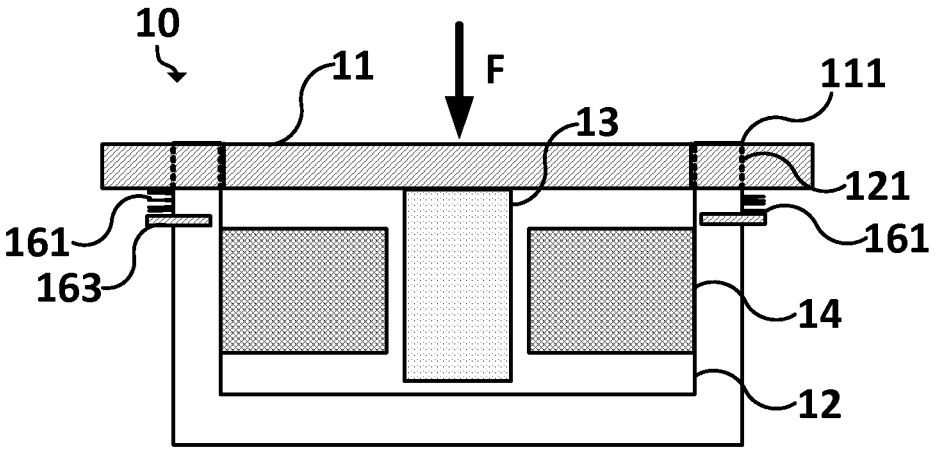
FIG. 3B is a sectional view illustrating a power generation device with applied force according to another embodiment of the invention.

Please refer to FIGS. 3A and 3B. FIG. 3A is a sectional view illustrating a power generation device without applied force according to another embodiment of the invention. FIG. 3B is a sectional view illustrating a power generation device with applied force according to another embodiment of the invention.

As shown in FIGS. 3A and 3B, the power generation device 10 of the embodiment is in essence the same with the power generation device 10 in FIGS. 2A and 2B, thus the components thereof need not be elaborate any further. To be noticed, the difference between the two embodiments is that, in this embodiment, the first flexible component 161 is configured between the first halving joint 111 and the second halving joint 121 for providing a resilience to the first housing 11 to resist the corresponding force F. With a fixed structure 163 configured on the inner or outer side wall of the second housing 12, the flexible component 161 can against the surface of the second housing 12 so as to apply a force continuously corresponding to the direction of the force F.

Figure 4A:
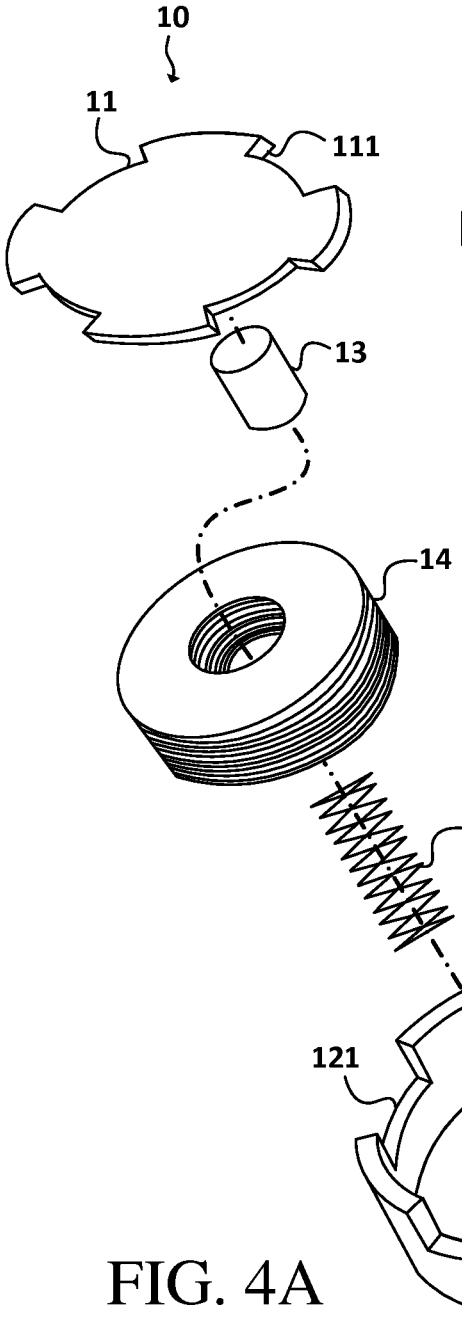
FIG. 4A is an explosion diagram illustrating a power generation device according to another embodiment of the invention.
Figure 4B:
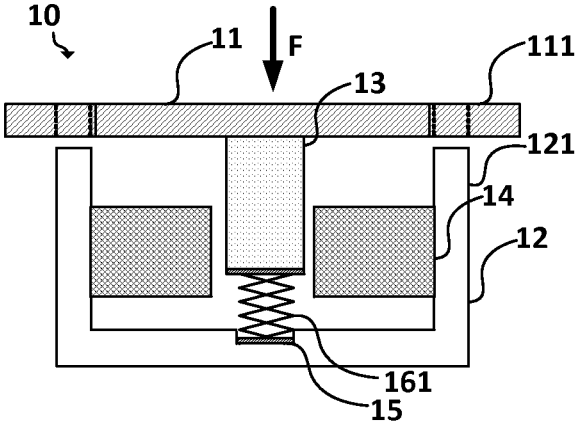
FIG. 4B is a sectional view illustrating a power generation device according to another embodiment of the invention.

Furthermore, in other to improve the performance of the power generation device 10, the present invention provides another embodiment. Please refer to FIGS. 4A and 4B. FIG. 4A is an explosion diagram illustrating a power generation device according to another embodiment of the invention. FIG. 4B is a sectional view illustrating a power generation device according to another embodiment of the invention. Wherein, the design of FIGS. 4A and 4B are in essence the same with the design of FIGS. 2A and 2B, thus repetitive descriptions will therefore be omitted. To be noticed, in this embodiment, the power generation device 10 further comprises a first piezoelectricity module 15.

The first piezoelectricity module 15 is configured between the magnetic component 13 and the second housing 12. When the magnetic component 13 applies a pressure on the second housing 12 for causing the first piezoelectricity module 15 to deform, and meanwhile, the first piezoelectricity module 15 absorbs the pressure between the magnetic component 13 and the second housing 12 to produce a first electric charge. To be more precise, when applying a force F on the first piezoelectricity module 15, the first piezoelectricity module 15 may produce a deformation and lead to a potential difference between the two opposite area, so that a first electric charge corresponding to the pressure can be produced. In the embodiment, the first piezoelectricity module 15 is coupled with the electricity storing device 50 for conveying the first electric charge to the electricity storing device 50 and converting the first electric charge to electrical energy. To be noticed, when the step-counting shoe 1 does not comprise the electricity device 50, the induction coil 14 can be connected to the pedometer device 30 directly or by the rectifying device 51.

Figure 5A:
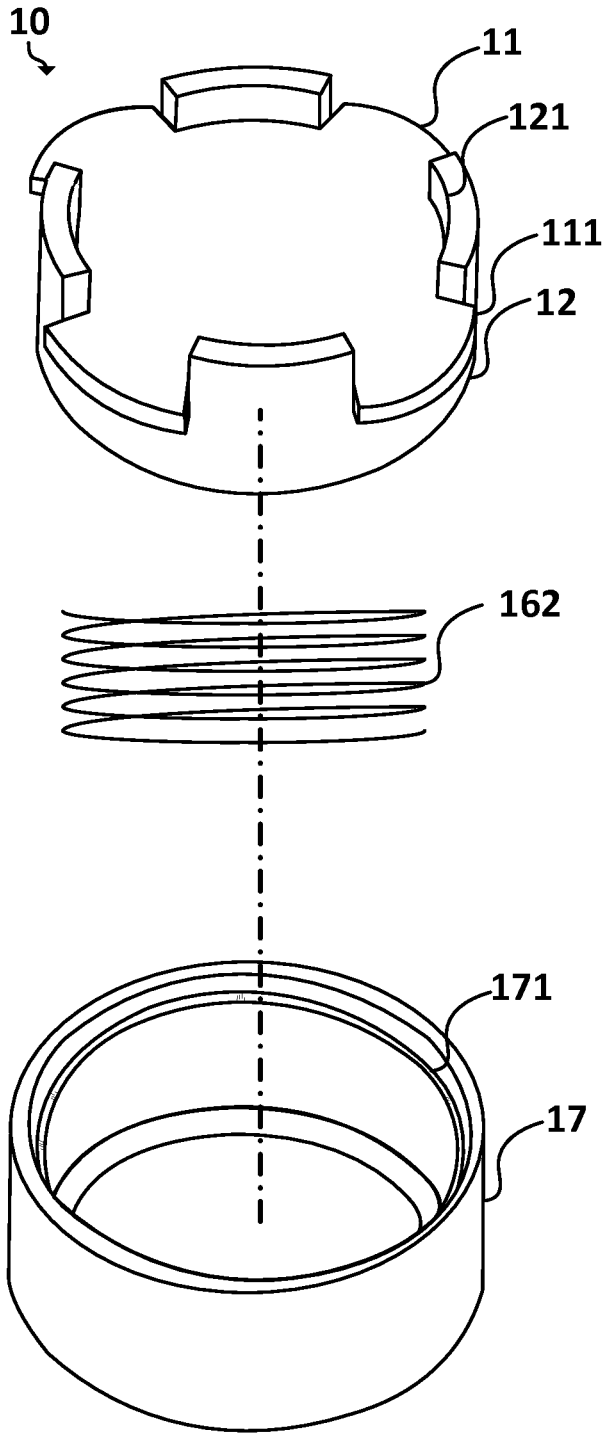
FIG. 5A is a three dimensional diagram illustrating a power generation device according to another embodiment of the invention.
Figure 5B:
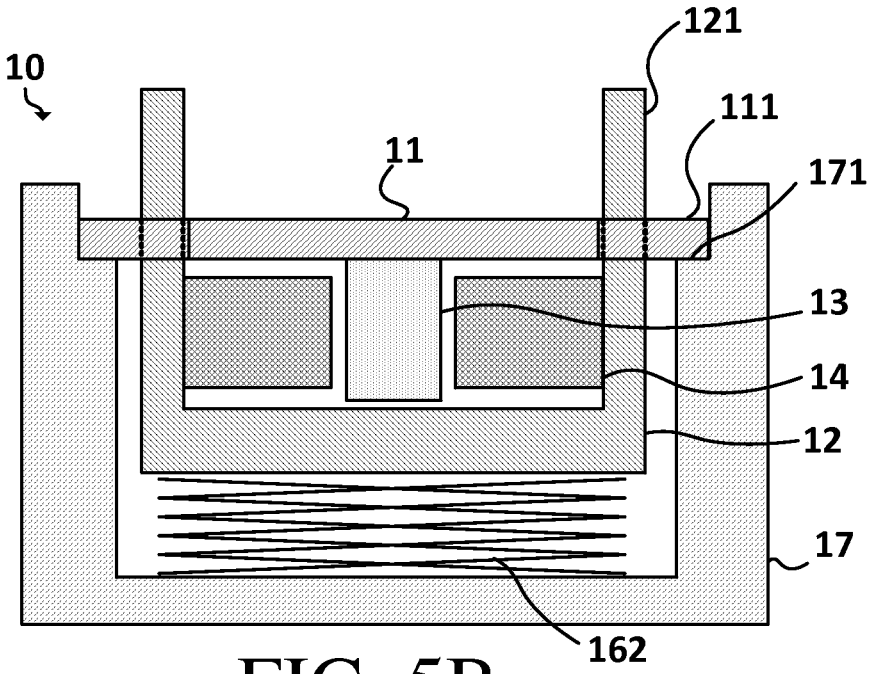
FIG. 5B is a sectional view illustrating a power generation device without applied force according to another embodiment of the invention.
Figure 5C:
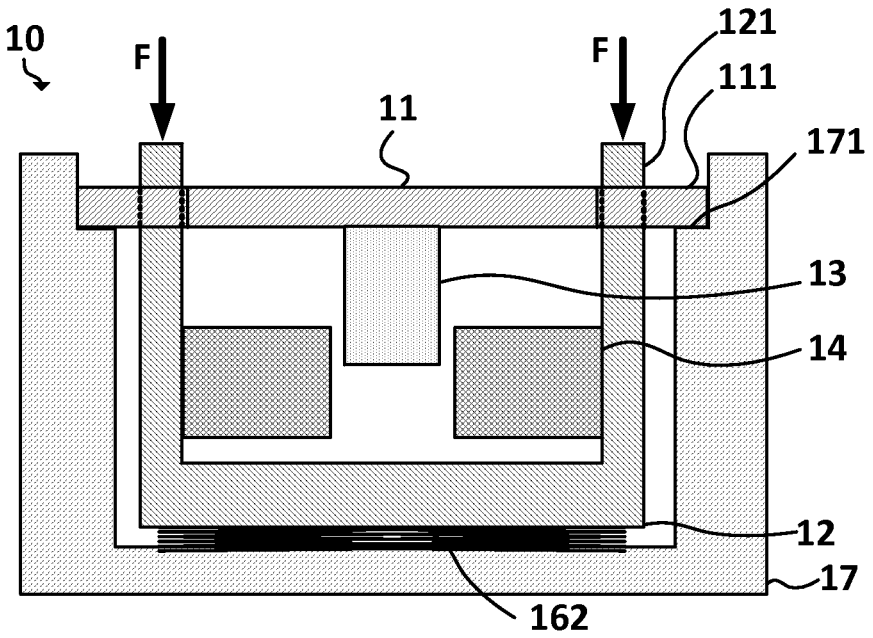
FIG. 5C is a section view illustrating a power generation device with applied force according to another embodiment of the invention.

Additionally, another type of the power generation device 10 is provided. Please refer to FIG. 5A to 5C. FIG. 5A is a three dimensional diagram illustrating a power generation device according to another embodiment of the invention. FIG. 5B is a sectional view illustrating a power generation device without applied force according to another embodiment of the invention. FIG. 5C is a section view illustrating a power generation device with applied force according to another embodiment of the invention. In this embodiment, the power generation device 10 comprises a first housing 11, a second housing 12, a third housing 17, a magnetic component 13, an induction coil 14, and a second flexible component 162.

Wherein, the first housing 11, the second housing 12, the magnetic component 13, and the induction coil 14 are in essence the same with the design of FIGS. 2A and 2B, thus repetitive descriptions will therefore be omitted. To be noticed, compared with the embodiments described in FIG. 2A to 4B, the difference between these embodiments is that, in this embodiment, the power generation device 10 comprises a third housing 17. The third housing 17 has a third halving joint 171, and the third halving joint 171 is utilized for holding the first halving joint 111. When a force F is applied on the power generation device 10, the second housing 12, or the third housing 17, a relative motion may be produced between the second housing 12 and the third housing 17. Moreover, the third halving joint 171 is a convex ring mounted on the inner periphery of the third housing 17 for holding the first halving joint 111. In this embodiment, the second flexible component 162 is configured between the second housing 12 and the third housing 17, when the power generation device 10 is applied with a force F, relative motion is produced between the second housing 12 and the third housing 17, and the second flexible component 162 provides a resilience against the force F. Additionally, the first flexible component 161 described previously can be added between the first housing 11 and the second housing 12 in this embodiment optionally according to FIG. 2A to 4B.

Figure 5D:
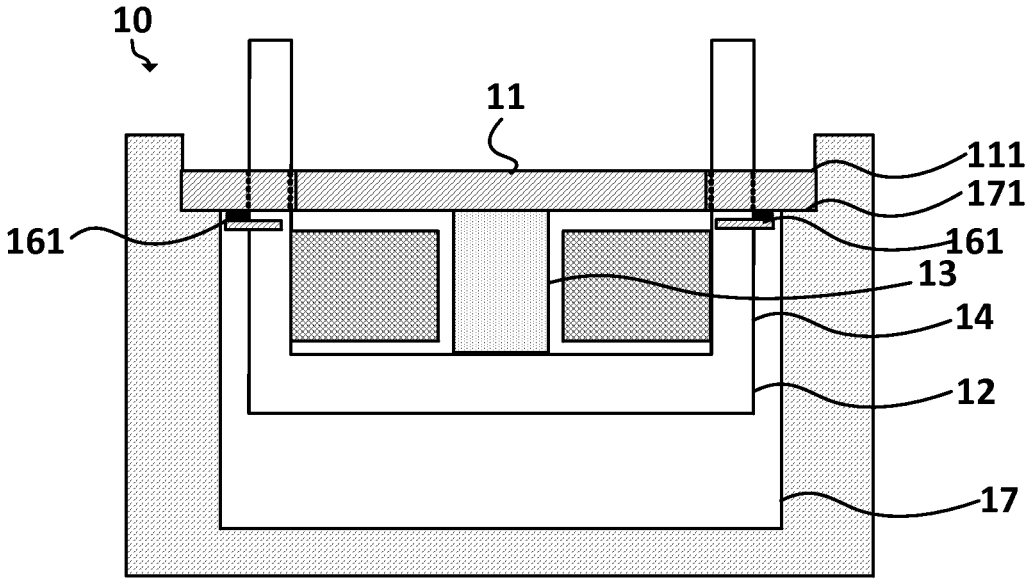
FIG. 5D is a section view illustrating a power generation device without applied force according to another embodiment of the invention.
Figure 5E:
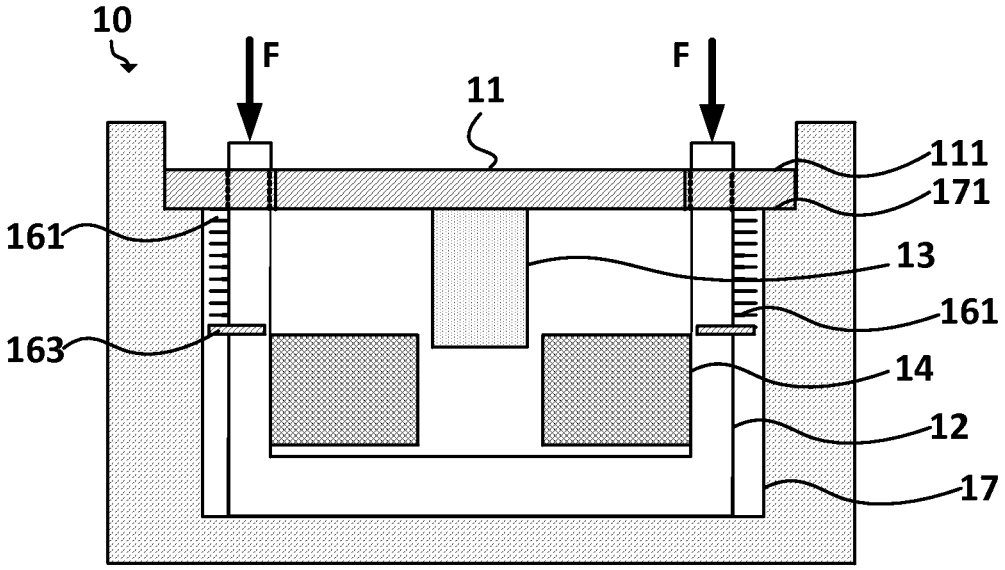
FIG. 5E is a section view illustrating a power generation device with applied force according to another embodiment of the invention.

More specifically, FIG. 5D is a section view illustrating a power generation device without applied force according to another embodiment of the invention. FIG. 5E is a section view illustrating a power generation device with applied force according to another embodiment of the invention. As shown in FIGS. 5D and 5E, the first flexible component 161 is added between the first halving joint 111 and the second halving joint 121 for providing a resilience against the corresponding force F. In this embodiment, when the second housing 12 is applied with a force F, the first flexible component 161 is elongated; when the force F is removed, the first flexible component 161 would provide an opposite force to the second housing 12 so as to make the second housing 12 return to the original position. To be noticed, the difference between this embodiment and the embodiments described in FIGS. 5A and 5B is in the configuration of flexible component thereof.

Figure 6A:
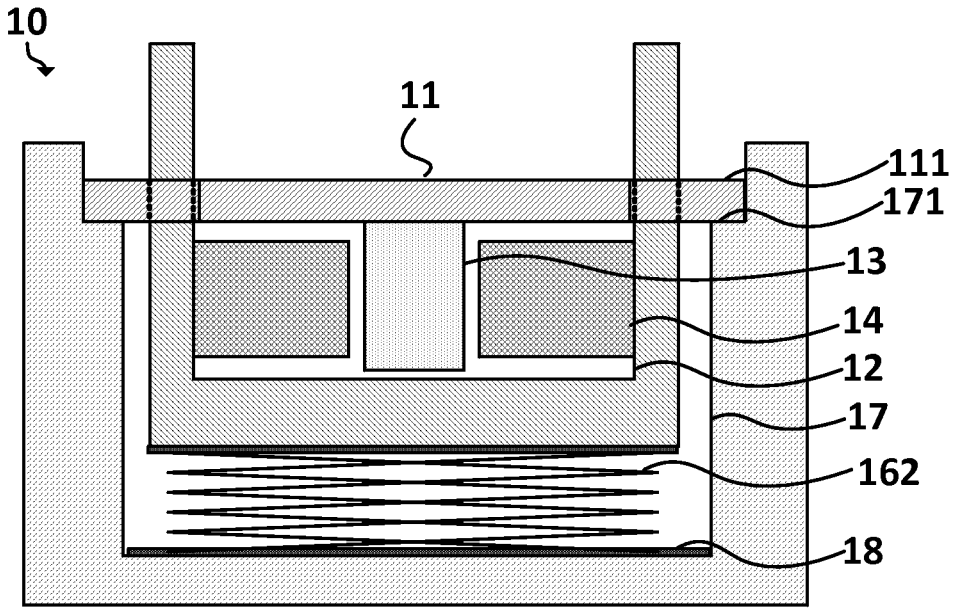
FIG. 6A is a sectional view illustrating a power generation device without applied force according to another embodiment of the invention.
Figure 6B:
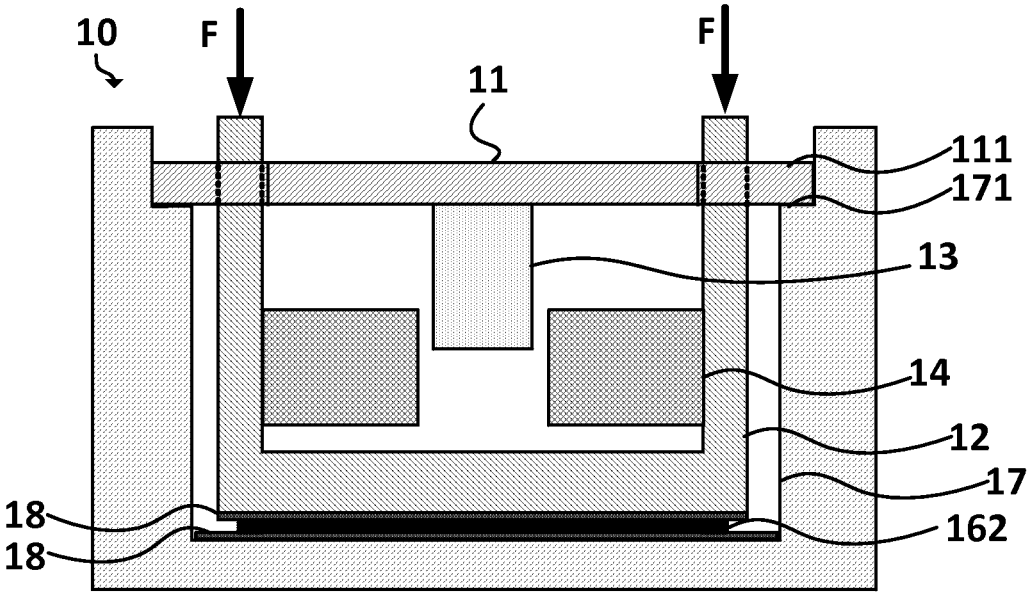
FIG. 6B is a sectional view illustrating a power generation device with applied force according to another embodiment of the invention.

In another embodiment, the power generation device 10 can further comprise a second piezoelectricity module 18. Please refer to FIGS. 6A and 6B. FIG. 6A is a sectional view illustrating a power generation device without applied force according to another embodiment of the invention. FIG. 6B is a sectional view illustrating a power generation device with applied force according to another embodiment of the invention.

Figure 6C:
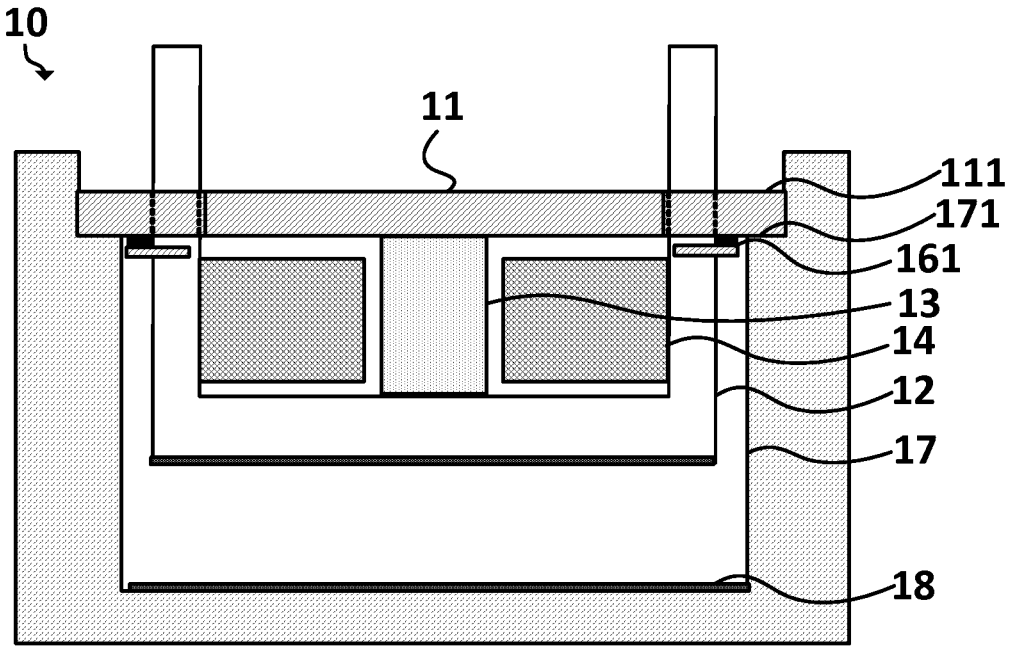
FIG. 6C is a sectional view illustrating a power generation device without applied force according to another embodiment of the invention.
Figure 6D:
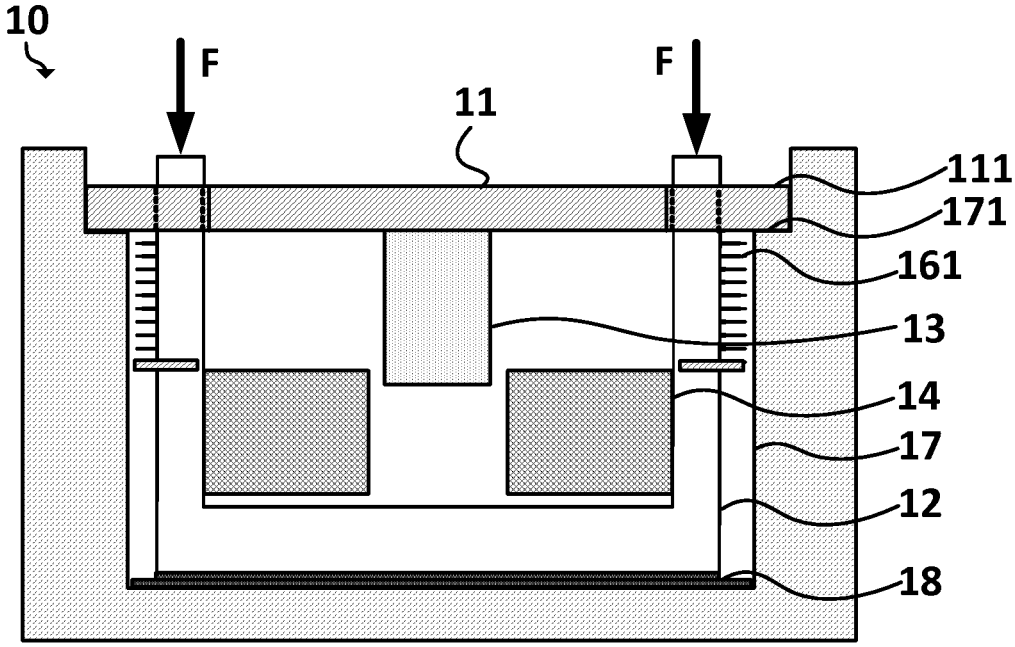
FIG. 6D is a section view illustrating a power generation device with applied force according to another embodiment of the invention.

As shown in FIGS. 6A and 6B, the second piezoelectricity module 18 is configured between the second housing 12 and the third housing 17, and used for absorbing the pressure between the second housing 12 and the third housing 17 to produce a second electric charge. To be more precise, when the second housing 12 is applied with a pressure, the second piezoelectricity module 18 may generate a deformation and produce a second electric charge corresponding to the pressure. Furthermore, the electricity storing device 50 can further be coupled with the second piezoelectricity module 18 for storing the induced current and the second electric charge to supply power to the pedometer device 30 and the control device 40. When the electricity storing device 50 is omitted, the power generation device 10 can be connected to the pedometer device 30 directly or by the rectifying device 51. To be noticed, the second flexible component 162 illustrated in FIGS. 6A and 6B can be configured between the first housing 11 and the second housing 12, as shown in FIGS. 6C and 6D. Besides, the first piezoelectricity module 15 described in FIG. 4B can be integrated into the embodiments optionally according FIG. 6A to 6D respectively, so as to obtain more electrical energy.

The first piezoelectricity module 15 and the second piezoelectricity module 18 mentioned previously are further illustrated as follows. When applying a force F on the first piezoelectricity module 15 or the second piezoelectricity module 18, the piezoelectricity module 15 or 18 may produce a deformation and lead to a potential difference between the two opposite area, so that a first or second electric charge corresponding to the pressure can be produced respectively. Wherein, the first piezoelectricity module 15 and the second piezoelectricity module 18 can be a piece of piezoelectric material, a plurality of piezoelectric materials, or other complex structure shown in FIGS. 7A and 7B.

Figure 7A:
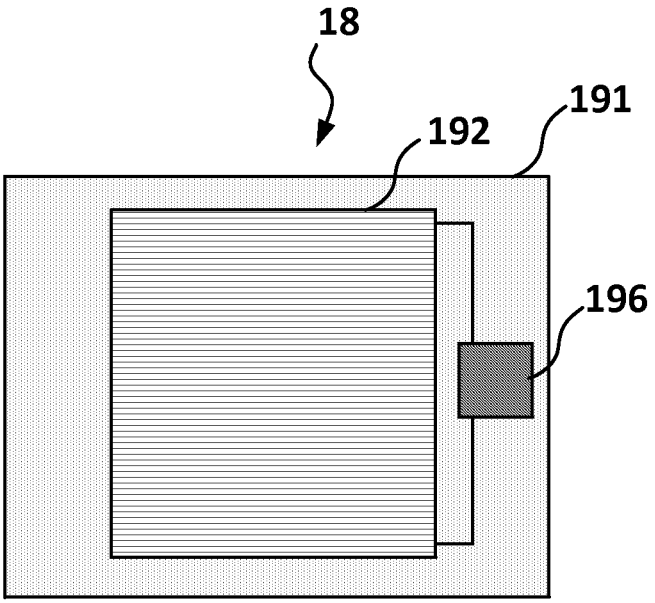
FIG. 7A is a schematic diagram illustrating a power generation device according to another embodiment of the invention.
Figure 7B:
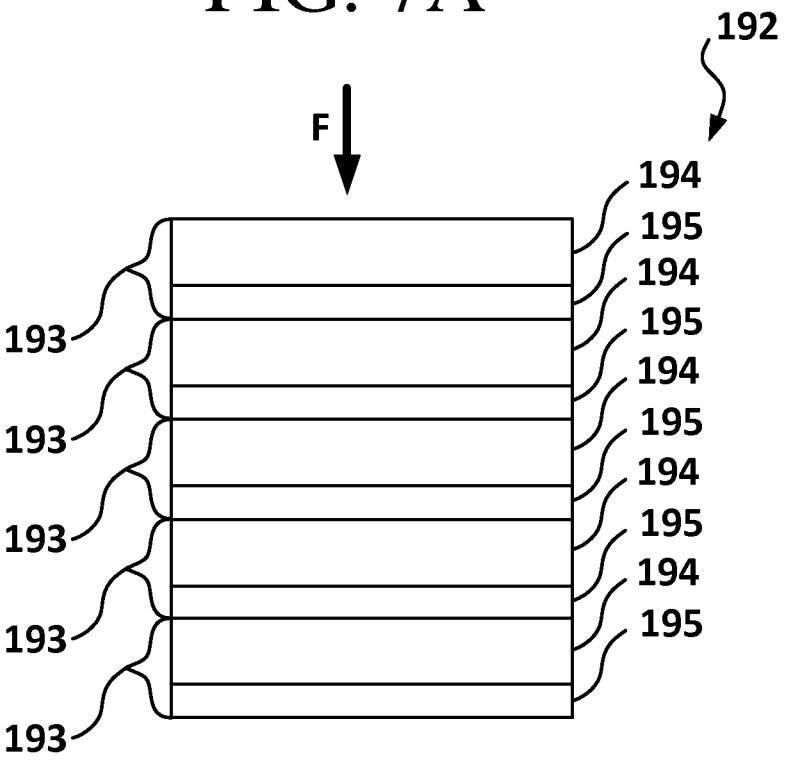
FIG. 7B is a schematic diagram illustrating a piezoelectricity component of power generation device according to another embodiment of the invention.

FIG. 7A is a schematic diagram illustrating a power generation device according to another embodiment of the invention. FIG. 7B is a schematic diagram illustrating a piezoelectricity component of power generation device according to another embodiment of the invention. In order to be understood clearly, this embodiment takes the second piezoelectricity module 18 as an illustration. In this embodiment, the first piezoelectricity module 15 or the second piezoelectricity module 18 of the power generation device 10 comprises an elastomer 191 and a piezoelectricity component 192. The elastomer 191 has a first elasticity coefficient. The piezoelectricity component 192 is configured in the elastomer 191 for producing a first or second electric charge. To be more precise, when the elastomer 191 is applied with a force, the piezoelectricity component 192 would undergo a shape change and lead to produce a first or second electric charge correspondingly. Furthermore, the electricity storing device 50 can further be coupled with the piezoelectricity component 192 for storing the first or second electric charge to supply power to the pedometer device 30 and the control device 40. When the electricity storing device 50 is omitted, the power generation device 10 can be connected to the pedometer device 30 directly or by the rectifying device 51.

In one of the embodiment, the piezoelectricity component 192 comprises a plurality of piezoelectricity units 193, and each piezoelectricity unit 193 has a second elasticity coefficient and comprises a piezoelectric material 194 and a metal sheet 195. Additionally, the piezoelectricity component 192 is configured in the elastomer 191, in order to avoid the damage of the piezoelectricity component 192.

Moreover, the lattices of the piezoelectric material 194 have a specified arrangement, causing a linear electromechanical interaction between the mechanical and the electrical state in crystalline materials. When applying a stress to the piezoelectric material 194, the electric dipole moment of materials would produce a change and lead to generate voltage. In actual application, the piezoelectric material 194 can be made from lithium niobate ($LiNbO_3$), lithium tantalate ($LiTaO_3$), potassium dihydrogen phosphate (KDP, $KH_2PO_4$), ammonium dihydrogen phosphate (ADP, $NH_4H_2PO_4$), lead hydrogen phosphate ($PbHPO_4$), or other ferroelectric crystals, or other materials exhibiting piezoelectricity.

In one of the embodiment, the piezoelectric material 194 is served as an anode, and the metal sheet 195 is served as a cathode. Therefore, as shown in FIG. 7B, the piezoelectricity units 193 are formed by stacking the piezoelectric material 194 and the metal sheet 195 on each other; and the piezoelectricity component 192 can comprise a plurality of piezoelectricity units 193 with each other.

Furthermore, the elastomer 191 has a first elasticity coefficient, and the piezoelectricity component 192 has a second elasticity coefficient. In the embodiment, the second elasticity coefficient is larger than the first elasticity coefficient, therefore, when the elastomer 191 and the piezoelectricity component 192 are applied with the same force F, the deformation of the elastomer 191 would not be smaller than the deformation of the piezoelectricity component 192, that is to say, the deformation of the piezoelectricity component 192 would not be restricted to the elastomer 191. In actual application, in order to avoid electrical leakage or short circuit, the elastomer 191 is made of insulating material, such as silicone rubber, butyl rubber, silicone resin, or other high molecular polymers.

Please refer to FIG. 7A again, the first piezoelectricity module 15 or the second piezoelectricity module 18 can further comprise a circuitry 196 which is configured in the elastomer 191 and electrically connected with the piezoelectricity component 192. In the embodiment, the circuitry 196 is integrated with the rectifying device 51 so as to regulate and compile the first or second electric charge produced from the piezoelectricity component 192 for providing a relatively stable electrical energy. Moreover, the elastomer 191 is a waterproof material wrapping the piezoelectricity component 192 and the circuitry 196 entirely.

Please refer to FIG. 7A again. As shown in FIG. 7A, when the piezoelectricity component 192 is applied with a force F, the deformation of the piezoelectricity component 192 may cause piezoelectric effect and further generate electrical energy, and meanwhile, the electrical energy may be regulated by the circuitry 196 first, and then the electrical energy may be conveyed to the electricity storing device 50 or the pedometer device 30 directly. Therefore, the present invention can record the number of steps taken in walking without external power supply.

Furthermore, when the power demand is smaller, the first piezoelectricity module 15 or the second piezoelectricity module 18 illustrated in FIGS. 7A and 7B can replace the power generation device 10 of the present invention, and the first housing 11, the second housing 12, or the third housing 17 can be omitted so as to reduce costs. To be noticed, the scope of the present invention is not limited to these embodiments.

According to the embodiments described above, the present invention produces electrical energy by applying a force to the shoe body without external power supply or replacing the battery, so as to generate power for the pedometer device 30 automatically during the user walking. In addition, a suitable power generation device can be adopted depending on the power demand, thickness of step-counting shoe, and/or costs.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A step-counting shoe, comprising:

a shoe body having a bottom;

a power generation device configured to the bottom, comprising:

a first housing having an at least one first halving joint;

a second housing having an at least one second halving joint, wherein the second halving joint is removably assembled to the first halving joint for forming a space between the first housing and the second housing;

a magnetic component mounted on the first housing and inside the space;

an induction coil mounted on the second housing and inside the space, the induction coil configured around the periphery of the magnetic component; and a first piezoelectricity module configured between the magnetic component and the second housing;

a pedometer device coupled with the power generation device, utilized for recording a number of steps; and a display device coupled with the power generation device, the display device having an at least one LED unit, and utilized for showing the number of steps;

wherein, when the power generation device is applied with a force, relative motion is produced between the first housing and the second housing for causing the induction coil to generate a magnetic flux to produce an induced current, and meanwhile, the first piezoelectricity module absorbs the pressure between the magnetic component and the second housing to produce a first electric charge.

2. The step-counting shoe of claim 1, wherein the LED unit of the display device uses flicker frequency or luminous color to show the number of steps correspondingly.

3. The step-counting shoe of claim 1, further comprising:

a control device coupled with the pedometer device and the display device, utilized for controlling the display device to show the number of steps; and an electricity storing device coupled with the induction coil and the first piezoelectricity module, utilized for storing the induced current and the first electric charge to supply power to the display device.

4. The step-counting shoe of claim 3, further comprising:

a second display device coupled with the electricity storing device, the second display device having an at least one LED unit, and utilized for showing the dump energy of the electricity storing device.

5. The step-counting shoe of claim 1, further comprising:

a rectifying device coupled with the power generation device for receiving the induced current and the first electric charge to generate a direct current; and an interface device coupled with the rectifying device for supplying the direct current to an external electronic apparatus.

6. The step-counting shoe of claim 1, wherein the power generation device comprises:

a first flexible component configured between the first housing and the second housing, when the power generation device is applied with the force, relative motion is produced between the first housing and the second housing, and the first flexible component provides a resilience to the first housing or the second housing.

7. The step-counting shoe of claim 1, wherein the first piezoelectricity module comprises:

an elastomer having a first elasticity coefficient; and a piezoelectricity component configured in the elastomer for producing the first electric charge, the piezoelectricity component comprising a plurality of piezoelectricity units, each piezoelectricity unit having a second elasticity coefficient and comprising a piezoelectric material and a metal sheet;

wherein, the second elasticity coefficient is larger than the first elasticity coefficient.

8. A step-counting shoe, comprising:

a shoe body having a bottom;

a power generation device configured to the bottom, comprising:

a first housing having an at least one first halving joint;

a second housing having an at least one second halving joint, wherein the second halving joint is removably assembled to the first halving joint for forming a space between the first housing and the second housing;

a magnetic component mounted on the first housing and inside the space;

an induction coil mounted on the second housing and inside the space, the induction coil configured around the periphery of the magnetic component;

a third housing having a third halving joint, and utilized for holding the first halving joint; and a second piezoelectricity module configured between the second housing and the third housing;

a pedometer device coupled with the power generation device, utilized for recording a number of steps; and a display device coupled with the power generation device, the display device having an at least one LED unit, and utilized for showing the number of steps;

wherein, when the power generation device is applied with a force, relative motion is produced between the first housing and the second housing for causing the induction coil to generate a magnetic flux to produce an induced current, and meanwhile, the second piezoelectricity module absorbs the pressure between the second housing and the third housing to produce a second electric charge.

9. The step-counting shoe of claim 8, wherein the LED unit of the display device uses flicker frequency or luminous color to show the number of steps correspondingly.

10. The step-counting shoe of claim 8, further comprising:

a control device coupled with the pedometer device and the display device, utilized for controlling the display device to show the number of steps; and an electricity storing device coupled with the induction coil and the second piezoelectricity module, utilized for storing the induced current and the second electric charge to supply power to the display device.

11. The step-counting shoe of claim 10, further comprising:

a second display device coupled with the electricity storing device, the second display device having an at least one LED unit, and utilized for showing the dump energy of the electricity storing device.

12. The step-counting shoe of claim 8, further comprising:

a rectifying device coupled with the power generation device for receiving the induced current and the second electric charge to generate a direct current; and an interface device coupled with the rectifying device for supplying the direct current to an external electronic apparatus.

13. The step-counting shoe of claim 8, wherein the power generation device comprises:

a first flexible component configured between the first housing and the second housing, when the power generation device is applied with the force, relative motion is produced between the first housing and the second housing, and the first flexible component provides a resilience to the first housing or the second housing.

14. The step-counting shoe of claim 8, wherein the power generation device further comprises:

a second flexible component configured between the second housing and the third housing, when the power generation device is applied with the force, relative motion is produced between the second housing and the third housing, and the second flexible component provides a resilience to the second housing or the third housing.

15. The step-counting shoe of claim 8, wherein the second piezoelectricity module comprises:

an elastomer having a first elasticity coefficient; and a piezoelectricity component configured in the elastomer for producing the second electric charge, the piezoelectricity component comprising a plurality of piezoelectricity units, each piezoelectricity unit having a second elasticity coefficient and comprising a piezoelectric material and a metal sheet;

wherein, the second elasticity coefficient is larger than the first elasticity coefficient.

16. A step-counting shoe, comprising:

a shoe body having a bottom;

a power generation device configured to the bottom, comprising:

a first housing having an at least one first halving joint;

a second housing having an at least one second halving joint, wherein the second halving joint is removably assembled to the first halving joint for forming a space between the first housing and the second housing;

a magnetic component mounted on the first housing and inside the space; and an induction coil mounted on the second housing and inside the space, the induction coil configured around the periphery of the magnetic component;

a pedometer device coupled with the power generation device, utilized for recording a number of steps; and a display device coupled with the power generation device, the display device having an at least one LED unit, and utilized for showing the number of steps;

wherein, when the power generation device is applied with a force, relative motion is produced between the first housing and the second housing for causing the induction coil to generate a magnetic flux to produce an induced current.

17. A step-counting shoe, comprising:

a shoe body having a bottom;

a power generation device configured to the bottom, comprising:

an elastomer having a first elasticity coefficient; and a piezoelectricity component configured in the elastomer for producing a first electric charge, the piezoelectricity component comprising a plurality of piezoelectricity units with each other, one of piezoelectricity units having a second elasticity coefficient and comprising a piezoelectric material and a metal sheet;

a pedometer device coupled with the power generation device, utilized for recording a number of steps; and a display device coupled with the power generation device, the display device having an at least one LED unit, and utilized for showing the number of steps;

wherein, the second elasticity coefficient is larger than the first elasticity coefficient.

* * * * *